United States Patent [19]

Norman

[11] 4,129,494

[45] Dec. 12, 1978

[54] ELECTROLYTIC CELL FOR ELECTROWINNING OF METALS

[76] Inventor: Telfer E. Norman, P. O. Box 781, Green Valley, Ariz. 85614

[21] Appl. No.: 794,623

[22] Filed: May 4, 1977

[51] Int. Cl.[2] ..... C25C 7/00; C25C 7/04

[52] U.S. Cl. ..... 204/268; 204/269; 204/275

[58] Field of Search ..... 204/275, 255, 257, 263, 204/269, 268

[56] References Cited

U.S. PATENT DOCUMENTS

| | | | |
|---|---|---|---|
| 700,941 | 5/1902 | Keith | 204/269 |
| 968,492 | 8/1910 | McDorman | 204/269 |
| 1,207,261 | 12/1916 | Alling | 204/275 |
| 3,389,071 | 6/1968 | Meyers | 204/275 |

FOREIGN PATENT DOCUMENTS

| | | | |
|---|---|---|---|
| 15669 | 10/1893 | United Kingdom | 204/269 |
| 429020 | 10/1974 | U.S.S.R. | 204/269 |

*Primary Examiner*—T. M. Tufariello

*Attorney, Agent, or Firm*—Horace B. Van Valkenburgh; Frank C. Lowe

[57] ABSTRACT

Outlet weir of tank is lower than inlet and electrolyte is forced to flow in alternately downward and upward paths between anodes and cathodes at velocities in excess of 10 feet per minute and preferably 20 to 100 feet per minute. Cathodes (or anodes) are spaced from bottom of tank for flow underneath and anodes (or cathodes) have an upper edge of active area over which electrolyte flows, to produce upward and downward paths. Difference of electrolyte level between downward and upward flow cycles is at least ¼ inch and not more than 6 inches, while spacing between adjacent electrodes is at least ¼ inch and not more than 3 inches. Levels of upper edges of active areas may be consecutively lower and bottom of tank may slope downwardly to correspond.

Electrolyte velocity eliminates or reduces ion-deficient film tending to form on electrode faces, with advantages including formation of more coherent, smooth and dense deposits, good quality deposits at higher current densities, reduction in voltage drop, improvement in cathode current efficiency, reduction in impurities in the cathode deposits, efficient electrowinning from very dilute solutions of metal and maintenance of slurry suspensions of ground ore in electrolyte for concurrent leaching and electrowinning.

Electrically non-conductive sheets may be placed in down path between cathode and anode, as on face of cathode, to restrict deposition to upflow surface, with elimination of bubbles on downflow surface, which interfere with electro-deposition.

12 Claims, 10 Drawing Figures

ELECTROLYTIC CELL FOR ELECTROWINNING OF METALS

This invention relates to electrolytic cells for use in the electrowinning of metals.

BACKGROUND OF THE INVENTION

Much of the world's production of copper, zinc and nickel is recovered by electrolytic processes in which the metal is produced in relatively pure form by deposition from aqueous solutions, on the cathodes of electrolytic cells. Similar electrolytic processes are sometimes used for the production of cobalt, manganese and the precious metals. In the electrowinning of metals, the metal to be recovered is first dissolved by chemical means in the electrolyte, which is then passed through an electrolytic cell containing insoluble anodes. The metal ions in the electrolyte are discharged at the cathode surface by passage of direct electric current, to form a deposit of relatively pure metal, while an equivalent number of negative ions, such as hydroxyl or sulfate ions, are discharged at the anode and then reform with the release of molecular oxygen bubbles. In some cases, the reaction at the anode involves the oxidation of metal ions, such as ferrous or cuprous ions, which are converted to the ferric and cupric state, respectively. The insoluble anode material used in electrowinning operations is usually a lead or lead alloy, or graphite or titanium coated with a thin coating of platinum. Certain other anodically insoluble materials have also been used.

In the design of electrolytic cells, it is necessary to provide open access at the top surface of each cell, so that the cathodes may be easily inserted and removed and to permit the escape of oxygen gas formed at the anode and any hydrogen gas which may be produced at the cathode. The surface of the electrolyte in these cells is therefore essentially at atmospheric pressure.

Extensive research has been conducted to determine the most favorable or most economical conditions for electrolytic cell operation in specific applications. One important operating factor is the velocity of flow of the electrolyte across the active faces of the electrodes. It has been demonstrated by many investigators that it is desirable to maintain a flow of electrolyte at relatively high velocities across the faces of the electrodes. This eliminates or reduces the ion-deficient film which tends to form at these faces during electrolysis. Some specific advantages of maintaining high velocity flow of the electrolyte across the electrode faces are as follows:

(1) The cathodically deposited metal tends to form a more coherent, smooth and dense deposit relatively free from the nodule or "tree" growths, which often cause short circuiting of the electric current between anodes and cathodes.

(2) Good quality cathode deposits can be formed at higher current densities, which in turn increase the metal productions rate of each cell.

(3) For a given current density, the voltage drop between anode and cathode is reduced, thus saving in the electric energy required per pound of metal deposited at the cathode.

(4) Cathode current efficiency is improved, since there is less evolution of hydrogen at the cathode and since there is also less short circuiting through nodule or "tree" growths on the cathode. The improvement in current efficiency also produces an equivalent improvement in energy efficiency.

(5) Impurities in the cathode deposit are reduced, since the deposit is smooth and does not entrap particulates suspended in the electrolyte.

(6) Since the metal-ion-deficient film at the cathode is thinner, it is possible to electrowin certain metals, with reasonable current efficiencies, from very dilute solutions of that metal.

(7) Under some operating conditions, such as when very dilute solutions are electrolyzed, or when very high current densities are applied, the metal is deposited at the cathode as a loosely adhering sponge. With a high flow rate of the electrolyte across the cathode surface, this metal sponge becomes suspended in the electrolyte and can be collected, as fast as it forms, from the discharged electrolyte. A cell of this type requires little manual attention and operates with a relatively low labor cost.

(8) Slurry suspensions of ground ore or concentrates can be maintained in the electrolyte. Certain metals, such as copper, lead and nickel can be concurrently leached and electrowon from these slurries to provide a relatively low cost and non-polluting method for recovery of these metals from their ores or concentrates.

The attainment of high velocity flow of the electrolyte across the electrode faces of electrowinning cells is fairly easily accomplished in laboratory size cells by mechanical stirring, by the use of a rotating anode or cathode, or by providing a rising flow of gas bubbles between the anode and cathode. Ultrasonic agitation also has proved advantageous in improving the physical quality of cathode deposits. The advantages of high velocity flow and some of the methods of cell designs developed to improve flow velocities in laboratory or commercial cells are well summarized in the paper by W. R. Hopkins, G. Eggett and J. B. Scuffham on "Electrowinning of Copper," Chapter 7, International Symposium on Hydrometallurgy, A.I.M.E. meeting, Chicago, IL, Feb. 25–Mar. 1, 1973, Library of Congress Card No. 72-88874. Their summary indicated that good cathode deposits could be produced at current densities of 100 amperes per square foot in copper electrowinning cells, when the electrolyte flow velocity between the electrodes was 15 feet per minute. For comparison, in normal copper electrolytic cells, where flow velocities are generated by convection currents of only a few feet per minute at best, it has been necessary to hold current densities down to about 15 to 20 amperes per square foot, in order to obtain cathode deposits of good physical quality. Other investigators have reported that flow velocities of about 50 feet per minute substantially reduced the thickness of the ion-deficient film on the electrode surfaces.

Commercial electrowinning cells usually involve the use of about 50 or more cathode sheets or plates uniformly spaced in interleaved arrangement with plate type anodes inside a rectangular tank. Total active surface area of the cathodes in each cell usually exceeds 1000 square feet. Heretofore, no economically practical method has been developed to maintain electrolyte flow velocities in excess of 10 feet per minute over such large cathode areas in these commercial cells. Several methods of improving flow velocities have, however, achieved limited commercial success. One such method involves the CCS cell design described in the paper by P. T. W. Strub and E. J. Clugston on "The CCS Cell Reduced to Practice," A.I.M.E. annual meeting, San Francisco, California, 1972, in which the electrolyte is recirculated at high volume rates to a central header in the bottom of each cell and is swept up between anode and cathode pairs to discharge over weirs on each side of the cell. This achieves upward flow velocities up to about 6 feet per minute, but requires recirculation pumping of very high volumes of electrolyte. The high investment and operating cost of these cells has prevented their adoption at most electrowinning plants.

Another method of improving flow velocities of the electrolyte between anode and cathode pairs is to inject gas (usually air) into the electrolyte at the bottom of the cell, so that the gas bubbles sweep upward between the electrode surfaces. This method, however, produces several disadvantages. The rising gas bubbles increase the electrical resistance and consequently the voltage drop between anode and cathode and thus reduces energy efficiency. The gas bubbles also tend to reduce the operating temperature of the electrolyte, which further increases voltage drop. Consequently, this method of "gas sparging" has received little use commercially.

Another means of increasing the velocity of electrolyte flow, by the use of deflectors appropriately spaced along each side of the cell, was proposed by W. R. Sorenson et al in U.S. Pat. No. 3,558,455. However, this method produces only a mild increase in flow velocities, which are well below the desired minimum velocities of 10 to 15 feet per minute.

SUMMARY OF THE INVENTION

The principal purpose of this invention is to provide a practical and economical means of increasing the flow velocity of electrolyte over the surface of anodes and cathodes in electrowinning cells and thus provide the improvements in operation which are associated with increased flow velocities. It is the object of this invention to produce flow velocities in excess of 10 feet per minute and preferably in the range of 20 to 100 feet per minute.

The high flow velocities of this invention are produced by bringing the entire flow of electrolyte into one end of the cell and forcing it to pass successively in alternating downward and upward directions between the plate type electrodes, after which the electrolyte flows out of the opposite end of the cell. Said flow is induced by maintaining the surface of the electrolyte at the feed end of the cell at a substantially higher level than the surface level of the electrolyte at the discharge end of the cell and by fitting the side edges of the rectangular plate type electrodes into close contact with the two sides of the cell, thereby forcing the electrolyte to flow alternately under the lower edge of one electrode, thence upwardly and over the upper edge of the next electrode, through the respective spaces provided for this flow. The desired flow velocity is produced by the differential in surface level of the electrolyte between each cycle of downward and upward flow. This differential normally ranges betwen ½ inch and 2 inches, depending on the desired flow velocity and flow volume, though in extreme cases, where very high flow velocities are desired or where the electrolyte has a high viscosity, the said differential may be increased up to about 6 inches.

The electrolytic cell of the invention includes a tank of rectangular configuration in its plan view. The sides and ends of the tank are vertical and the interior sides are fitted with vertically disposed spacer slots or strips, so that the side edges of the electrodes fit into these slots or between the strips, to maintain a uniform spacing for the electrolyte to flow between each anode and cathode face. The top edges of each side of the tank may conveniently slope downwards from the feed end toward the discharge end. The interior bottom surface of the tank may be horizontal, or it may also conveniently slope downwards from the feed end towards the discharge end. The tank has an opening at its discharge end which is fitted with a weir over which the electrolyte flows at a predetermined level, which is significantly lower than the surface level of the electrolyte at the feed end of the tank.

The cell of the invention includes a multiple number of electrodes made from electrically-conductive, rectangular sheets or plates. The electrodes are normally made from a suitable metal or metal alloy, or graphite. Each electrode forms an anode or cathode or when the electrodes operate electrically in a series arrangement, bipolar electrodes are used in which one face forms the cathode and the opposite face forms the anode. Bipolar electrodes may also be made from two suitable materials, with one material forming the cathodic face and the other material forming the anodic face. The electrodes operate in pairs in which one electrode contains an opening, usually rectangular, near its upper end through which the flow of electrolyte can pass, and the other electrode is a solid sheet or plate which forces the electrolyte to flow under its lower edge or under a non-conductive extension thereof, such as a baffle plate made from fiberglass or other non-metallic material.

A modification of this arrangement includes the insertion of a shield of non-conductive material between the anode and cathode faces in each space where the electrolyte flows in a downward direction, so that electrolytic action occurs only in those spaces between anode and cathode where the electrolyte flows in an upward direction. Since the vertical flow velocity of the electrolyte between each anode and cathode pair is determined by the successive drops in the surface level of the electrolyte, as it passes between each pair, it is often desirable, especially in cells with a large number of electrodes, to vertically drop the position of each successive electrode to match the desired drop in the level of the electrolyte as it passes through the cell. This is more clearly apparent by reference to the drawings.

The foregoing features and additional features, as well as additional advantages thereof and additional detail, will become apparent from the description which follows, taken in conjunction with the accompanying drawings, in which.

DETAILED DESCRIPTION OF THE INVENTION

Figure 1:
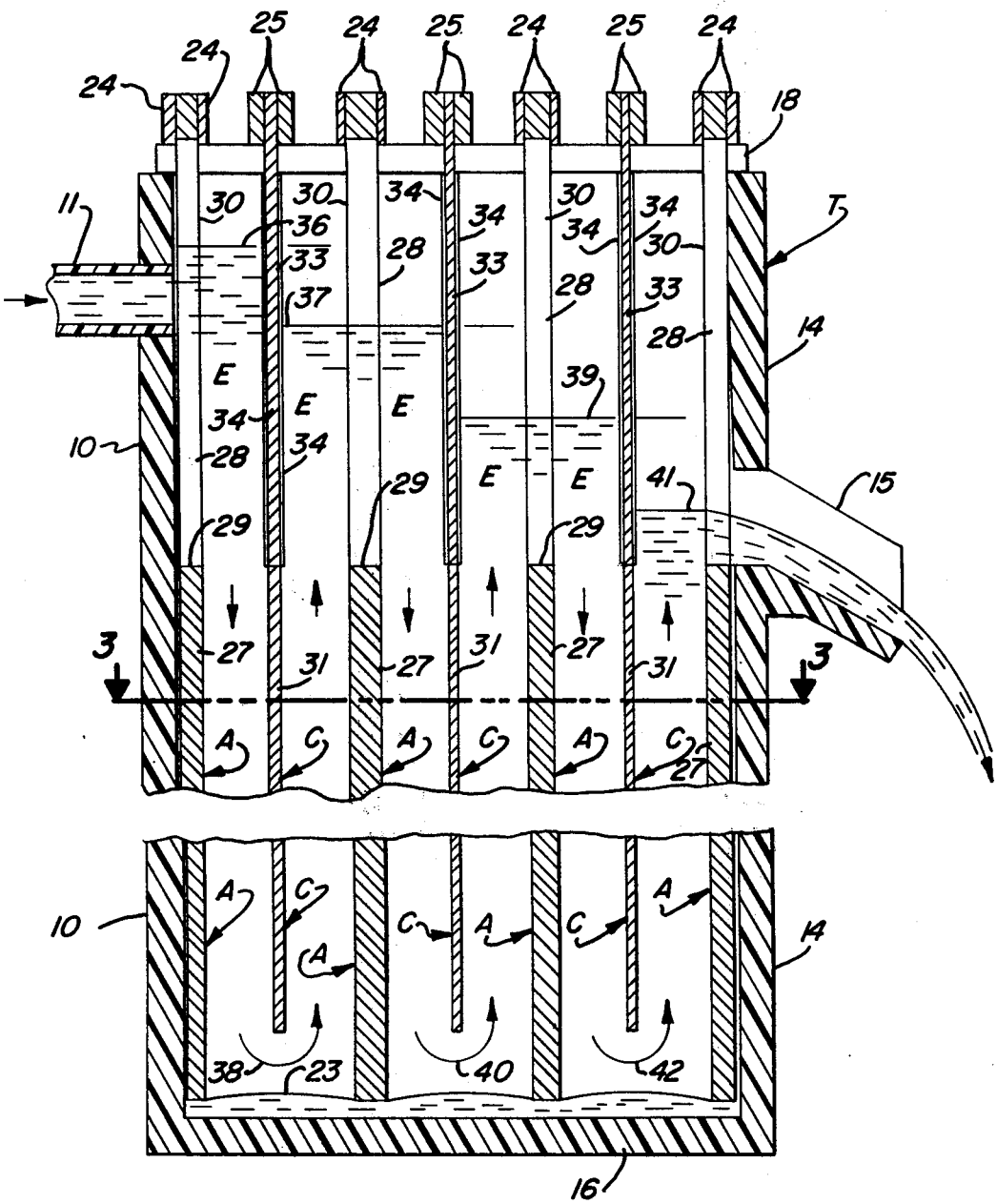
FIG. 1 is a longitudinal section of an electrolytic cell constructed in accordance with this invention, taken along line 1—1 of FIG. 2.

As shown in FIGS. 1–4, a series of anodes A and cathodes C may be mounted in spaced, alternative, parallel relation within a tank T of rectangular shape, having a front wall 10 provided with an inlet 11 for electrolyte E, side walls 12 and 13 and a rear wall 14 provided with a discharge weir 15 and a bottom 16. Weir 15 is placed at a predetermined level which is substantially below the surface level of the electrolyte at the inlet end of the tank, to produce a differential in level of the electrolyte E on opposite sides of each cathode C, as the electrolyte flows in its alternating downward and upward path between the anodes and cathodes, indicated by the arrows. The tank T may be formed of a suitable insulating and corrosion resistant material, such as a suitable plastic, normally reinforced by fiberglass or the like. In this embodiment, the electrodes are connected in a parallel circuit, i.e. all the anodes are electrically connected to a bus bar 17 and all of the cathodes are electrically connected to a bus bar 18, on opposite sides of the tank.

Figure 3:
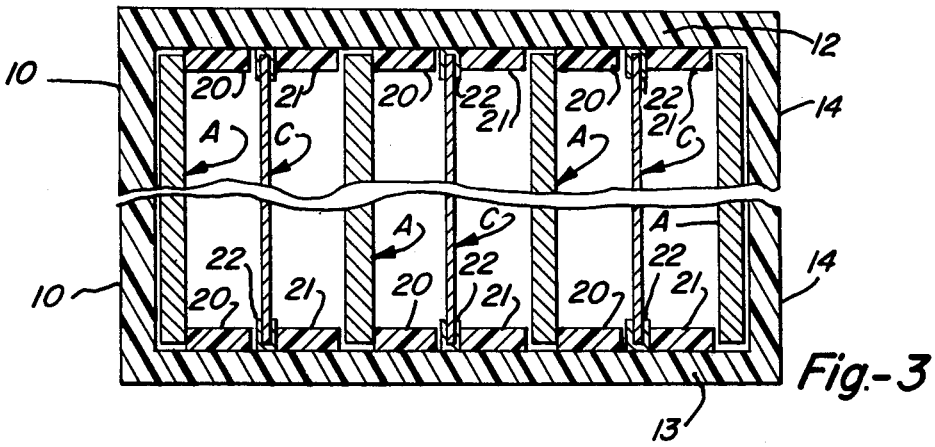
FIG. 3 is a horizontal cross section of the cell taken along line 3—3 of FIG. 1.
Figure 4:
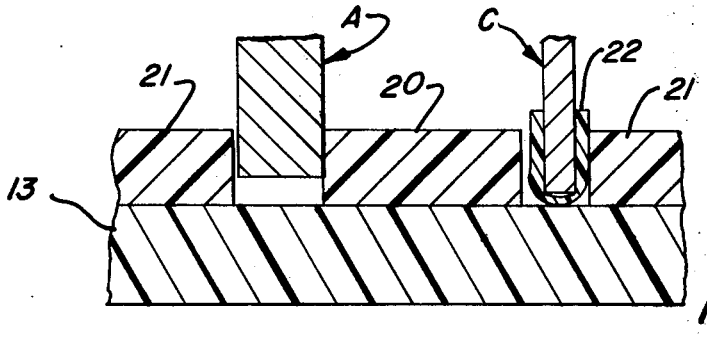
FIG. 4 is a fragmentary detail of FIG. 3, on an enlarged scale, showing the manner in which the electrodes may be sealed at their side edges.
Figure 2:
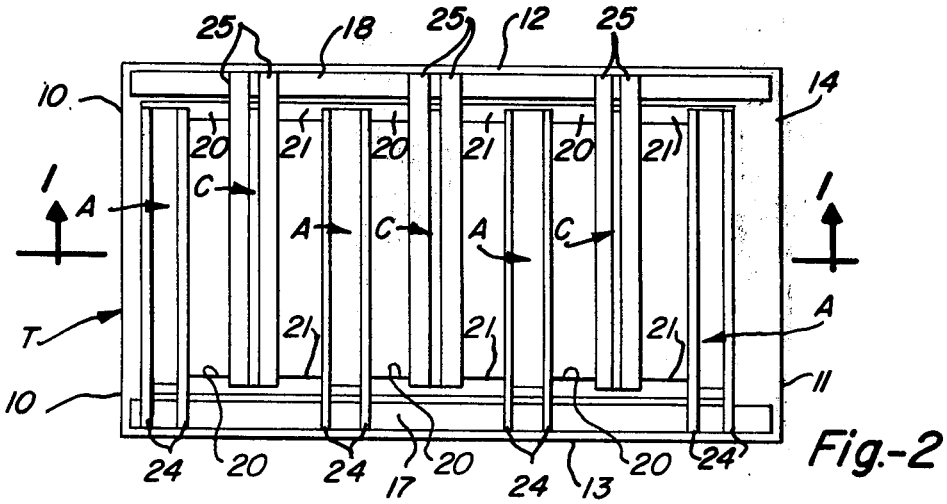
FIG. 2 is a top plan view of the cell of FIG. 1.

Each of the interior sides of the tank, as in FIGS. 1 and 3, has a series of vertically disposed spacer bars 20 and 21 fastened to or molded into said sides to provide vertically disposed slots. The side edges of anodes A and cathodes C fit loosely in alternate sequence into said slots. Anodes A are pressed by the differential hydraulic pressure against the edge of spacer bars 20 to prevent or minimize flow of electrolyte around the side edges of said anodes. Cathodes C are similarly pressed by the differential in hydraulic pressure against the edges of spacer bars 21 to prevent or minimize the flow of electrolyte around the side edges of said cathodes, with the edges of the cathodes, as in FIG. 4, preferably being provided with U-shaped, resilient sealing strips 22 extending around the edges, to prevent the deposition of metal on the edges of the cathodes, and consequent difficulty in stripping. If desired, a slotted strip of non-conductive material, such as rubber, wood or plastic may be utilized. The lower end of each of the anodes rests against the elastic cushion 23 which prevents any significant flow of electrolyte under the lower edge of the anode. However, the use of this elastic cushion is optional. The cathodes do not extend to the bottom of the tank, but instead leave a space of sufficient height so that the electrolyte can move in a relatively unrestricted manner under the lower end of each cathode.

The principal weight of the anodes A is borne by the suspending cross bus bars 24 which rest on and make contact with the anode bus bar 17, which, as indicated previously, rests on the upper edge of side 13 of the tank. The cathodes C are similarly suspended by cross bus bars 25 which rest on and make electrical contact with the bus bar 18, in turn resting on the upper edge of opposite side wall 12.

Figure 5:
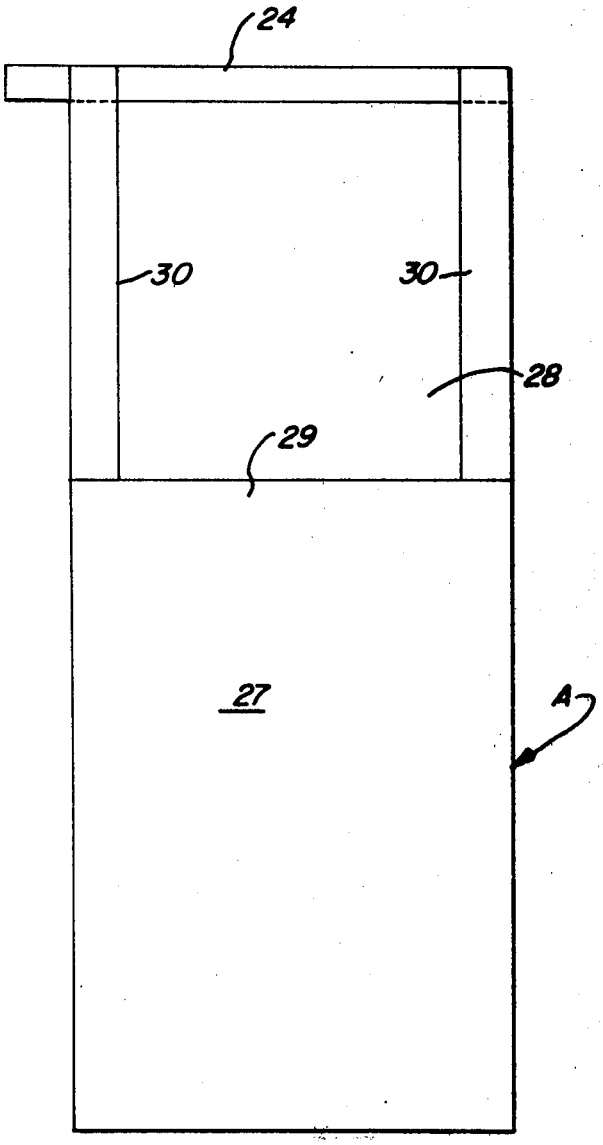
FIG. 5 is a front elevation of an anode which may be utilized in the electrolytic cell of FIG. 1.

Each anode A, as in FIG. 5, may be constructed of a plate of suitable material, such as metal or graphite. The electrically active part 27 of each anode is conveniently rectangular in shape, such as 3 feet wide and 4 feet high, to present a surface area of 12 square feet. Above the electrically active part is a rectangular opening 28 having a lower edge 29, which acts as a weir and over which the electrolyte flows in passing to the next cathode. An arm 30 flanks each side of the opening 28, the arms extending upwardly to the cross bus bars 24 and normally being made of the same material as the remainder of the anode.

Figure 6:
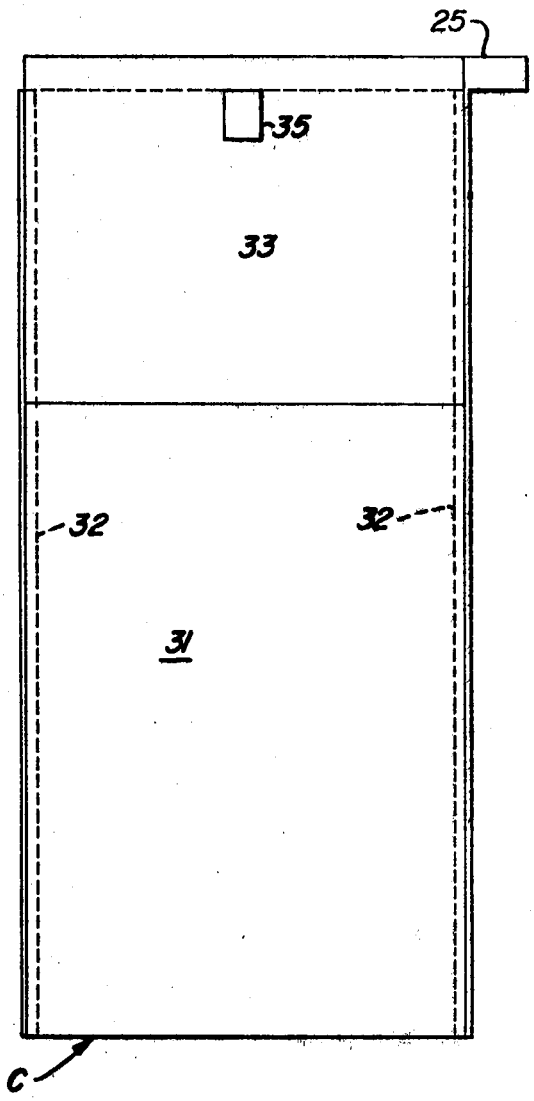
FIG. 6 is a front elevation of a cathode which may be used in the electrolytic cell of FIG. 1.

Each cathode C, as in FIG. 6, may be formed from a rectangular plate or sheet of suitable metal which is attached at the top to cross bus bars 25. The electrolytically active area 31 of the cathode corresponds in position, but may be slightly smaller in size, than the electrolytically active area 27 of the adjacent anode A. An area at each outer edge, extending inwardly to the dotted line 32 at each side, is electrolytically inactive due to the sealing and insulating strips 22, as described previously. An upper electrolytically inactive area 33, although optional, is normally covered with a non-conducting, corrosion resistant coating 34 of FIG. 1. Also, a hole 35 may be made in the cathode just below the cross bus bars 25, to receive a chain hook or the like, for lifting and lowering the respective cathode. The hole 35 should be placed well above the top level of the electrolyte, when the cathode is in its operating position in the cell, so that all of the electrolyte is forced to flow under the lower edge of the cathode. As indicated, the use of a non-conductive coating 34 on the upper inactive area 33 may be optional, since it would normally be used, for example, when zinc or copper is plated on and then mechanically stripped off an aluminum, titanium or stainless steel cathode. However, if copper is plated onto a copper cathode starting sheet, for example, there would be no advantage to be gained in the use of a non-conductive coating 34 on area 33.

It will be noted that the anodes and cathodes are placed at the same elevation for each in the cell of FIG. 1, and that the lower edge 29 of the opening 28 of the respective anodes are at the same level. However, the amount of electrolyte supplied to the cell through inlet 11 should be correlated with the difference in elevation between the inlet 11 and the outlet 15, so that the level 36 of the electrolyte between the first anode and cathode may be slightly higher than the inlet 11 and also higher than the electrolyte level 37 behind the second cathode. Thus, the difference between electrolyte levels 36 and 37 causes a strong flow around the bottom of the first cathode C, indicated by the arrow 38. Similarly, the electrolyte level 37 ahead of the second cathode is higher than the electrolyte level 39 behind the third cathode, so a strong flow of electrolyte around the bottom of the second cathode may be produced, as indicated by the arrow 40. Similarly, the difference in elevation of the electrolyte level 39 behind the third cathode and the electrolyte level 41 just before the outlet 15 produces a strong flow around the lower end of the third cathode, as indicated by the arrow 42.

In the embodiment of FIGS. 1–6, the electrolyte is directed in a repetitive downward and upward path of successive electrodes, as it flows through the cell. The theoretical maximum obtainable velocity of flow is indicated by the formula $V^2 = 2gh$. In English units "V" is expressed in feet per second, "g" is the acceleration of gravity i.e. about 32 feet per second, and "h" is the vertical drop in feet in the top level of the electrolyte between successive pairs of anodes and cathodes, as exemplified by the levels 36, 37, 39 and 41. In a cell of this invention, the value of "h" is normally between ¼ inch and 6 inches, i.e. 1/48 to ½ foot. Table I below lists calculated values of "V" for selected values of "h" in this range.

TABLE I

| h | | V | |
|---|---|---|---|
| (Inches) | (Feet) | (Ft. per second) | (Ft. per minute) |
| 1/4 | 1/48 | 1.15 | 69 |
| 1/2 | 1/24 | 1.63 | 98 |
| 1 | 1/12 | 2.31 | 139 |
| 2 | 1/6 | 3.27 | 196 |
| 4 | 1/3 | 4.62 | 277 |
| 6 | 1/2 | 5.66 | 340 |

The actual flow velocities of the electrolyte, in cells embodying the features of this invention, will always be substantially less than the values of "V" for a given value of "h" in Table I. This is due to the effects of friction and electrolyte viscosities on the flow velocity. In commercial size cells, a minimum value of "h" of ¼ inch will normally be required to insure flow velocity of the desired minimum of 10 feet per minute. For the preferred velocities of 20 to 100 feet per minute, the required value of "h" is normally between ⅜ inch and 2 inches.

The spaced distance between anodes and cathodes in the cell of the invention can be smaller than in conventional cells for electrowinning, since in the cell design of the invention, the anodes and cathodes are held parallel by slots or spacer bars on the sides of the tank, and since the cathode deposits are smooth, there is less tendency for short circuits between individual anodes and cathodes. The closer spacing between anode and cathode reduces voltage drop and thus reduces the electric energy requirements. The limitation in electrode spacing is largely determined by the desired volume of electrolyte which flows through the cell. For example, with a ½ inch space between the parallel anode and cathode surfaces and a flow velocity of 100 feet per minute in a 3 foot wide cell, the electrolyte flow rate is 12.5 cubic feet per minute, equivalent to 93.5 U.S. gallons per minute.

In the embodiment of FIGS. 1–6, the cell and electrode construction is one in which the electrolyte flows under the lower edge of each cathode and over the upper edge of the active area of each anode. An alternate arrangement may be used in which the anode and cathode designs are reversed, so that the electrolyte flows under the lower edge of the anode and over the upper edge of the active area of the cathode. Also, the construction may be modified, so that the lower edges of the electrodes rest on non-conductive baffle plates or pedestal plates set in the side slots between spacing blocks 20 and 21, so that the bottom of the electrolytically effective area of each electrode is raised to some desired position above the bottom of the tank.

FIGS. 1–6 illustrate a cell in which electrolysis occurs in both the downflow and upflow spaces between the electrodes. Under some circumstances, I have found it advantageous to limit the electrolytic action to the spaces where the electrolyte flow is in the upward direction, between the anodes and cathodes. This flow quickly carries the bubbles of oxygen evolved from the anode face to the top surface of the electrolyte, where the bubbles collapse and the oxygen is released into the atmosphere. The rapid removal of oxygen bubbles improves the electrical conductivity of the electrolyte and also tends to improve the current efficiency of metal deposition at the cathode, so that electric energy consumption of the cell, per unit weight of metal deposited, is reduced. To obtain this desirable effect, a modification of the electrode arrangement in a cell design is used. In this arrangement, the alternate downward and upward flow of electrolyte still occurs but no electrolytic action occurs in the downflow spaces between the electrodes, since it is prevented by placing a sheet of non-conductive material between the electrodes to prevent the flow of electrical current in the downflow spaces. This electrically non-conductive sheet, which may be an acid resistant plastic material, is preferably attached to one face of each cathode by adhesive bonding. Adhesive coated plastic sheets are commercially available and are well suited for this purpose.

Figure 7:
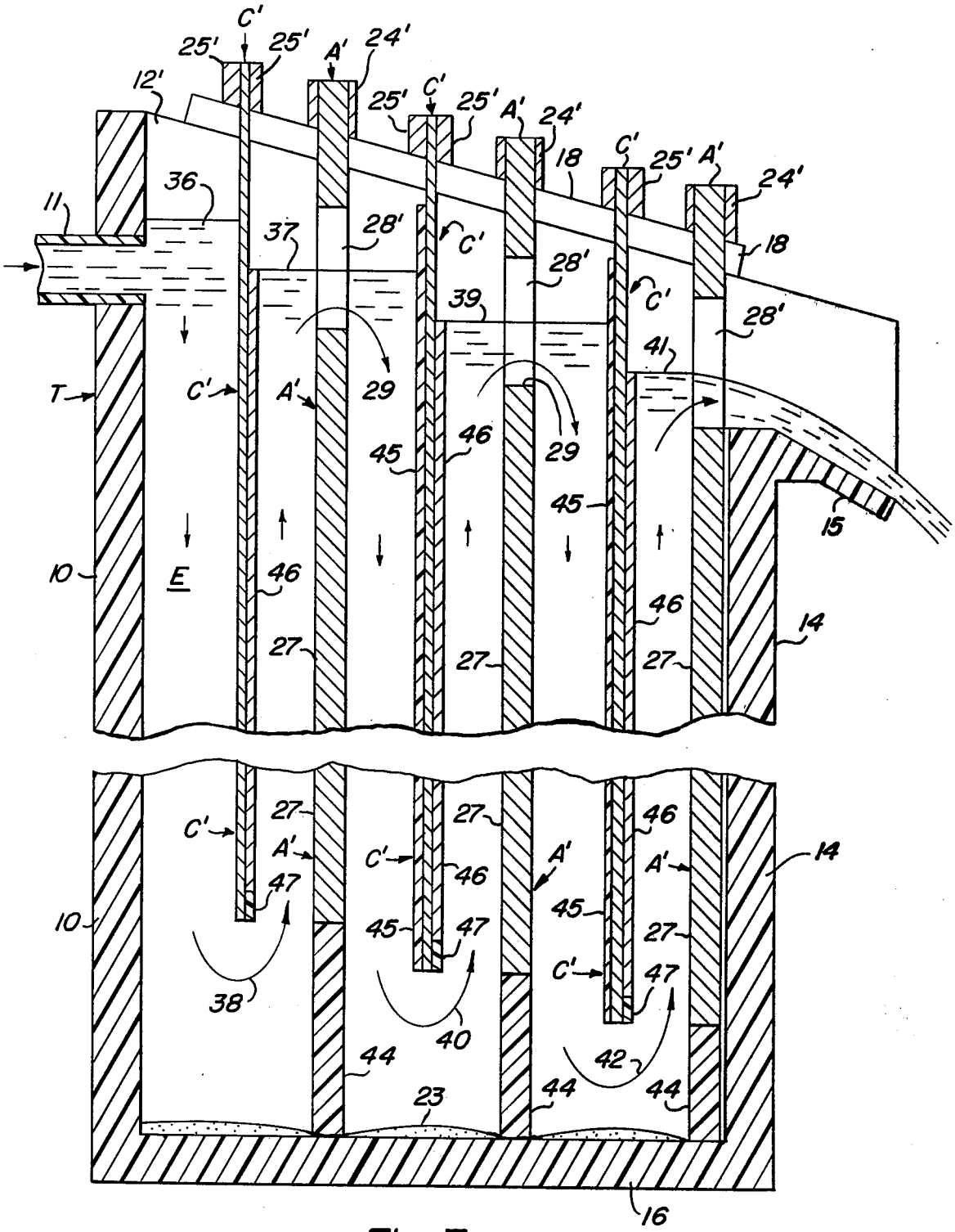
FIG. 7 is a condensed, longitudinal vertical section similar to FIG. 2, but showing an alternative cell or embodiment of this invention.

The embodiment of FIG. 7 illustrates an electrolytic cell design in which the electrodeposition on the cathode occurs only on the upflow side of each cathode. As before, tank T contains electrolyte E which flows into the tank through inlet 11 and leaves through outlet 15. Tank T also has a front wall 10, a side wall 12' having an inclined upper edge and a corresponding opposite side wall, a rear wall 14 and a bottom 16. The anodes A' each have an opening 28' to permit the flow of electrolyte over the top 29 of the electrolytically active face 27 of each anode. Each anode rests at its lower edge on a baffle plate 44 formed of non-conductive material and inserted in the corresponding slots in the side walls of the tank which receive the anodes. Each baffle plate 44, in turn, rests on a soft rubber or other elastic material which forms a pad 23 at the bottom of the tank. This arrangement effectively prevents bypass of the electrolyte under the bottom edge of each anode. The cathodes C', which may be made from aluminum or titanium or stainless steel, or other suitable electrically conductive material, are covered on one side by a shield 45, which is made from an electrically non-conductive material, such as plastic, and is preferably adhesively bonded to the "downflow" face of the cathode. The electrodeposited metal 46 forms on the opposite face of the cathode, above a narrow transverse insulation strip 47. Use of said strip is optional but is usually desirable to facilitate easier stripping of the deposited metal from the cathode.

A distribution bus bar 18 is placed on the upper edge of side 12 of the tank, with a similar bus bar on the upper edge of the opposite side of the tank, to act as the positive and negative terminals for each anode and cathode, respectively. The anodes are suspended from cross bus bars 24', which carry the principal weight of each anode and make electrical contact with the bus bar on the opposite side of the tank. The cathodes C' are suspended from cross bus bars 25' which carry the full weight of each cathode and its deposit and make electrical contact with bus bar 18. This arrangement represents the conventional electrical circuit for electrowinning cells, in which the anodes and cathodes in each cell are respectively connected in parallel or multiple, while each cell is connected in series with each side of the adjacent cell.

In FIG. 7, the lower edges of cathodes C' are a sufficient distance from the bottom of the tank, so that there is a full passage for the flow of electrolyte under the lower edge of each cathode, as indicated by the arrows 38, 40 and 42. As described in connection with FIGS. 1–6, the side edges of each anode and cathode fit into spaced slots vertically disposed on each side of each cell, so that the electrolyte is forced to flow, by gravity, in alternating downward and upward paths between each pair of electrodes, as indicated by the arrows. In FIG. 7, the electrolyte always flows in an upward direction between the electrolytically active faces of each anode and cathode and in a downward direction between the electrolytically inactive faces of each anode and cathode. This mode of operation is most conveniently applied to the cells of my invention in which the anodes and cathodes, respectively, are connected in parallel, though it is also adaptable to the cells of my invention in which modified bipolar electrodes operate in a series circuit.

Figure 8:
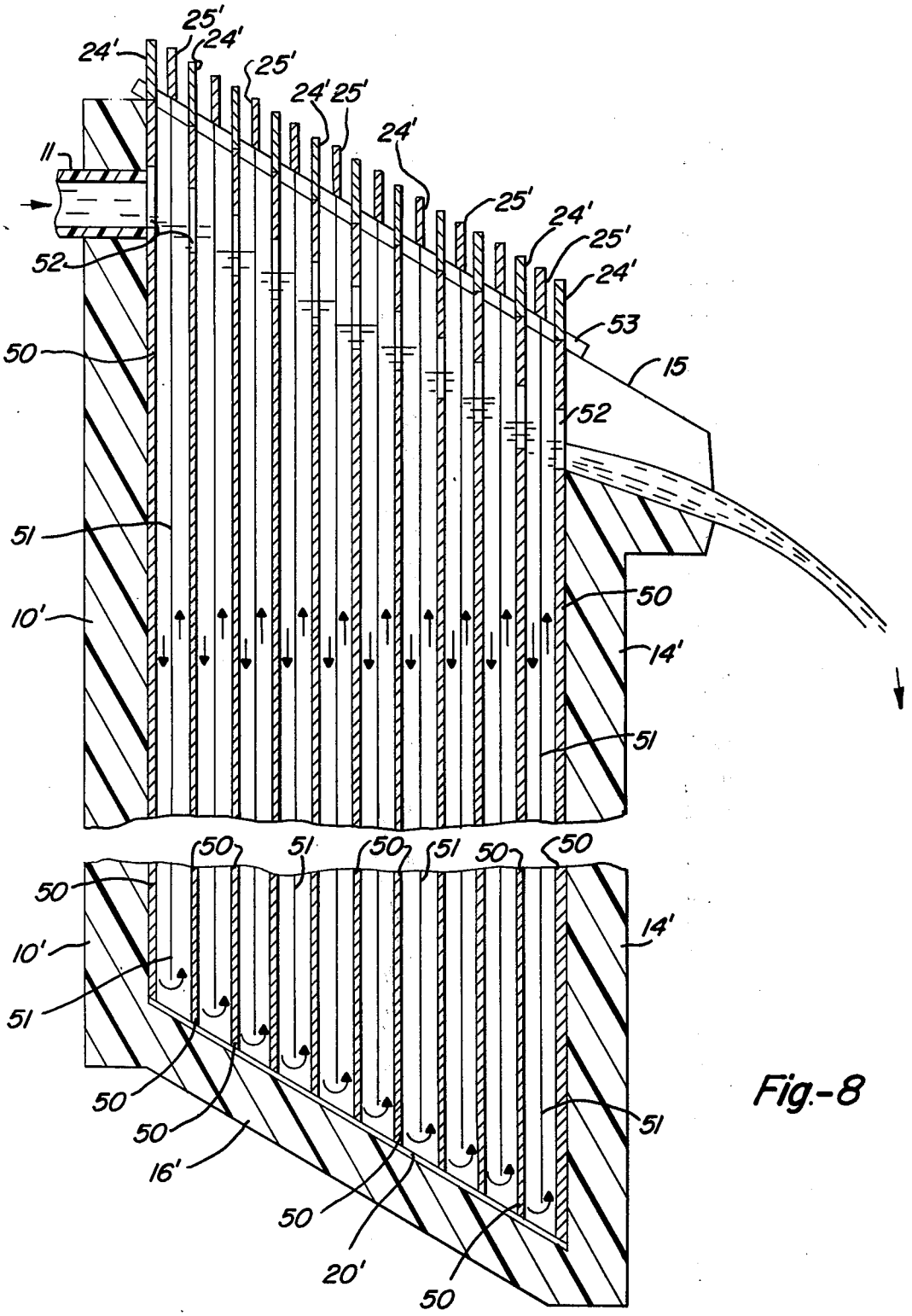
FIG. 8 is a similar section showing a further alternative cell or embodiment of this invention.

In the alternative cell or embodiment illustrated in FIG. 8, the front wall 10' of the tank is provided with an inlet 11 adjacent the top, while the upper and lower edges of the rear wall 14' are spaced below the corresponding parts of the front wall 10'. Thus, the bottom 16' slopes downwardly at an angle corresponding to the angle of the tops of the side walls which join the top of front wall 10' with the top of rear wall 14'. With the upper side edges and the bottom so inclined, the alternate anodes 50 and cathodes 51 may be inclined correspondingly, so that the position of each cathode and anode becomes lower and the holes 52 adjacent the upper ends of the anodes will be disposed in a downwardly stepped relation, producing the successively lower levels of electrolyte in each opening 52 in a corresponding relation. The electrolyte thus flows beneath the spaced lower edges of the cathodes 51, while the electrodes are connected in the conventional multiple or parallel circuit through a bus bar 53 placed on the top edge of the side wall shown and a similar bus bar placed on the top edge of the opposite side wall. The cathodes are supported by cross bus bars 25' which rest on and make electrical contact with the downwardly inclined bus bar 53. The anodes 50 are supported by cross bus bars 24' which rest on and make electrical contact with a similarly inclined bus bar, but on top of the opposite side of the tank.

The anodes 50 and cathodes 51 have an electrolytically active area about 3 feet wide and 4 feet high, with the anodes being approximately ½ inch thick and formed from a lead alloy insoluble in the electrolyte. The cathodes 51 may be 1/10 inch thick and formed from aluminum or titanium. With a ¾ inch space between each anode and cathode and a drop in "h" of the electrolyte level between each successive anode-cathode pair of one inch, an electrolyte flow velocity of approximately 50 feet per minute should be produced, which in turn would require an electrolyte flow rate of 70 gallons per minute. Only eleven anodes and ten cathodes are illustrated in FIG. 8, but the actual number for a commercial cell would be 51 anodes and 50 cathodes. Such a cell would operate at 30 amperes per square foot of cathode area, or a total demand of 36,000 amperes. This cell is particularly adapted to the electrowinning of copper or zinc from their respective sulfate solutions. In normal operation, the cathodes would be removed from the cells periodically, such as at one to three day intervals, and the deposited metal would be mechanically stripped off the cathodes. Assuming a 95% current efficiency, this cell would produce about 2,146 lbs. of copper per day or 2,206 lb. of zinc per day from their respective solutions.

In electrowinning operations, there are certain advantages to be gained from the use of high current densitites, such as in the range of 100 to 500 amperes per square foot of cathode area. However, when the electrodes in a commercial electrolytic cell operate at such high current densities in a parallel or multiple circuit, the total input current to each electrode and to each cell becomes very large. For example, in a cell with fifty cathodes, each with a 3 foot by 4 foot electrolytically active area, the current input per cathode at 150 amperes per square foot is 3,600 amperes and the current input per cell would be 180,000 amperes. This imposes very difficult design problems in obtaining adequate current carrying capacity from the bus bars and through the electrical contacts. Also, the electrical energy losses through the resistance of bus bars, contacts and electrodes, which increase as the square of the current, can become excessive. A solution to this problem is to design the cell so that the electrodes operate in series; that is, the current is introduced through an electrode at one end of the cell and leaves through an electrode at the other end. All intermediate electrodes are then of the bipolar type; that is, one face acts as a cathode and the other face acts as an anode. In this case, the same 3 foot by 4 foot electrolytically active area on each electrode and 150 amperes per square foot of cathode, the current input to each cell is only 1,800 amperes. Energy utilized for cells with the same total number of electrodes is about the same for both parallel and series types. For example, in the parallel type, the cell might require 180,000 amperes at 2.4 volts or 432 kilowatts, while the corresponding series cell would require 1,800 amperes at 240 volts, which also amounts to 432 kilowatts. The energy losses due to bus bar and contact resistance would, however, be much greater in the parallel type cell than in the series type.

Figure 9:
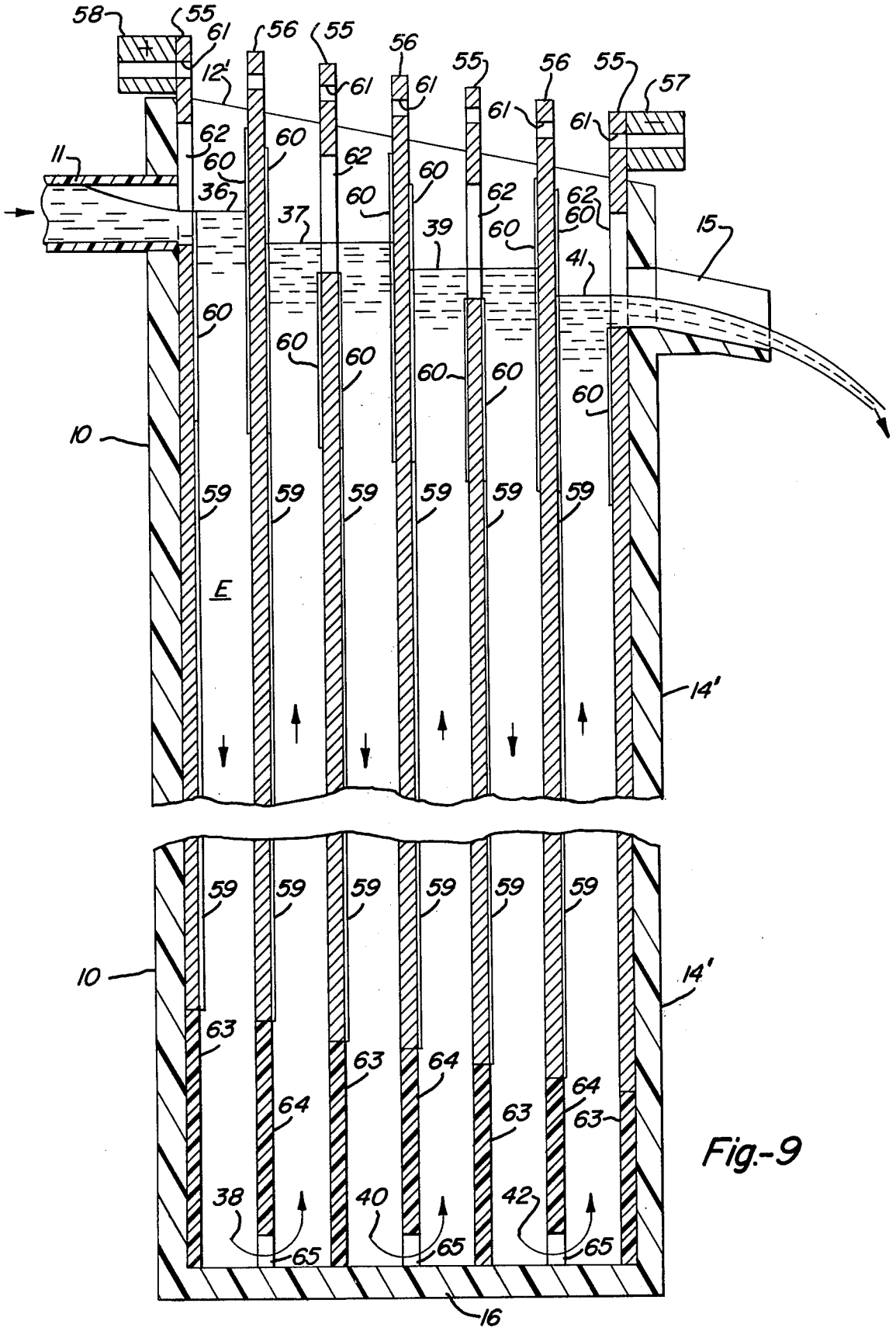
FIG. 9 is a similar section showing a still further alternative cell or embodiment of this invention.

One problem with the series type cell in conventional designs lies in the fact that a substantial amount of the electrical current tends to bypass around the immersed edges of the bipolar electrodes and is therefore wasted, since it is not used to produce electrodeposition of the metal on the cathode surfaces. This current bypass is easily prevented or greatly reduced in the cell of this invention, since the current bypass around the side edges of the bipolar electrodes is largely prevented by the close fit between these side edges and the sides of the cell, and bypass around the immersed lower and upper edges of the electrodes can be greatly reduced by the use of non-conductive baffle plates or insulating coatings for some vertical distance, such as 12 inches or more, at the lower and upper ends of the electrolytically active area of the electrodes. A series type cell which operates according to the principles of the invention, and which includes this provision for reducing the bypass current, is illustrated in FIG. 9. For example, in the cell illustrated in FIG. 9, if the average distance which the bypass current must travel to pass around an insulating baffle is 24 inches and the voltage drop through this distance is 5 volts, then in a typical acidified copper sulfate electrolyte (specific resistance = 2 ohm-cm), the current bypass is only about 6 amperes or less than 0.5% of the current which would normally be passing between the anode and cathode in a cell of this type.

The cell of FIG. 9 has a series of spaced, upright bipolar electrodes 55 interspaced with bipolar electrodes 56. A current of 1,200 to 1,800 amperes, for example, when defined in terms of electron flow, enters the cell through a negative terminal 57 connected to a bipolar electrode 55 at the outlet 15, thence passes through the electrolyte E to the anode face of adjacent bipolar electrode 56, thence to the cathode face of bipolar electrode 56 and on successively through the electrolyte and bipolar electrodes 55 and 56 until it emerges from the cell through a positive terminal 58, connected to the bipolar electrode 55 at inlet 11. The electrodes 55 and 56 and the electrolyte are contained in a tank having a front wall 10 having an inlet 11, a side wall 12' having a downwardly sloping top edge and a corresponding opposite side wall, a rear wall 14' having an outlet 15 and a bottom 16. The tank may be concrete, lined with a suitable plastic, or may be an all plastic material reinforced by fiberglass. Electrolyte E flows from inlet 11 in a successively downward and upward path through the cell, as indicated by the arrows, until it emerges at outlet 15.

Electrodes 55 and 56 may be ⅛ inch thick plates made from aluminum, titanium, stainless steel or other metal suitable for use as permanent cathode blanks. The electrolytically active area of these electrodes may be 4 feet high by 3 feet wide, to provide 12 square feet of active cathode surface and an equal area of active anode surface on each electrode. On each electrode, the active anode surface is plated with a coating 59 of insoluble metal, such as lead, platinum or other suitable conductive material, while the active cathode surface is opposite the anode coating 59. Above the electrolytically active areas, the electrodes 55 and 56 are covered with a layer 60 of corrosion resistant insulating material, such as adhesive backed polyethylene. Near the top of each electrode, a lift hole 61 is provided, while near the top of each electrode 55, an opening 62, as about 24 inches wide and 9 inches high, is cut to allow the electrolyte to flow through this opening above the lower edge thereof, to maintain the indicated levels 36, 37, 39 and 41. Electrodes 55 rest on baffle plates 63 formed of a non-conducting material, such as fiberglass reinforced plastic, which support the weight and vertically position these electrodes. The baffle plates 63 are set in the same vertical slots as the electrodes and provide a barrier to the bypass of both the electric current and the flow of electrolyte. Similarly, electrodes 56 rest on baffle plates 64, but in this case, an opening 65 is provided at the bottom of each baffle plate 64, through which the electrolyte flows in its passage through the cell, as indicated by the arrows 38, 40 and 42.

The space between the electrode faces in FIG. 9 is conveniently on the order of ½ inch. Thus, to produce the electrolyte flow velocities of about 75 to 100 feet per minute, which are preferred in cells operating at high current density, an "h" value (as previously defined) of 2 inches is maintained. A flow velocity of 75 feet per minute through this cell requires an electrolyte feed rate of 70 U.S. gallons per minute. Assuming that a commercial cell of the design shown in FIG. 9 has 51 electrodes, to provide 50 cathode surfaces, and operates at 100 amperes per square foot of cathode surface and 95% current efficiency, it should produce 3,576 lb. of copper or 3,676 lb. of zinc per 24 hours from their respective sulfate solutions. Due to the high deposition rate, it would be necessary to strip the deposited metal from the electrodes about once per 24 hour day.

A series type cell as illustrated in FIG. 9 is well adapted to a wide variety of applications. For example, it may be used to concurrently leach and electrowin metals from slurries of their respective ores or concentrates in suitable electrolytes. Normally, this procedure works best with high current densities and with considerable agitation of the slurry, which is an inherent characteristic in the cells of the invention. In the concurrent leach-electrowin processes, the strongly oxidizing conditions at the anode assist in dissolving the metal out of its ore or concentrate and the dissolved metal is then electrodeposited on the cathode.

A cell of the design illustrated in FIG. 9 can also be used to electrowin certain metals which tend to deposit on the cathode as a sponge or as a loosely adhering crystalline deposit. Such deposits tend to form at very high current densities, or when the current density is high relative to the concentration of metal ions in the electrolyte. When a metal sponge is formed on the cathode areas of the cell illustrated in FIG. 9, the high electrolyte flow velocities should sweep this sponge out of the cell as fast as it forms. The sponge can then be collected outside the cell by one of the usual means of solid-liquids separation, after which it can be melted and cast into ingots or other desired shapes.

Figure 10:
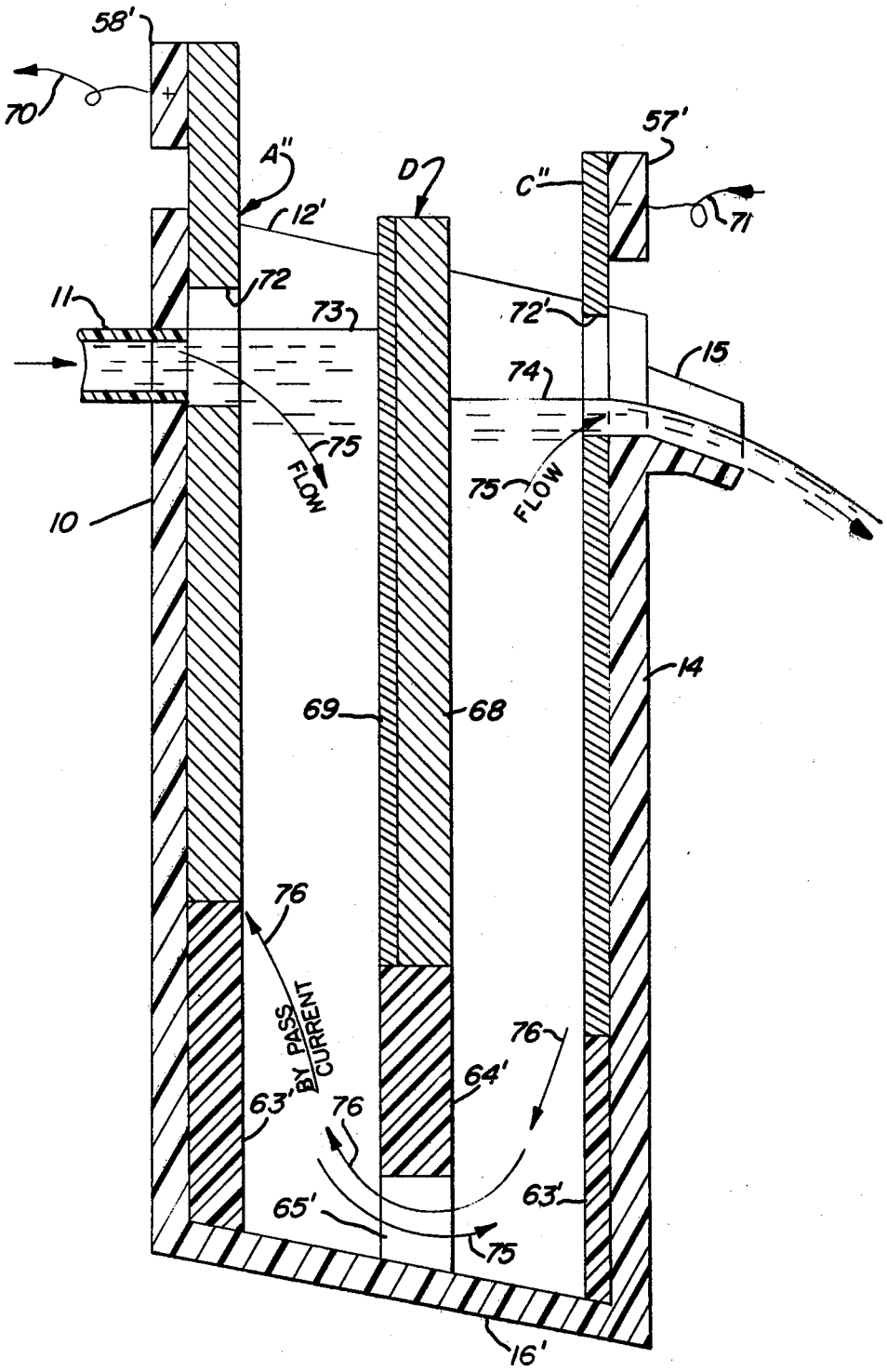
FIG. 10 is a condensed, longitudinal vertical section showing a further alternative cell or embodiment of this invention utilizing bipolar electrodes.

The series cell of FIG. 10, particularly suitable for test purposes, includes an anode A" at electrolyte inlet 11, a cathode C" at outlet 15 and an intermediate dual electrode D formed by attaching together an anode plate 68 and a cathode plate 69. Anode plate 68 should be formed of the same material as anode A", such as an insoluble lead alloy, while cathode plate 69 should be formed of the same material as cathode C", such as aluminum or titanium. Dual electrode D is placed in slots in a side wall 12' and a corresponding opposite side wall, with appropriate provision for preventing leakage of electrolyte E around the side edges, as described previously. The tank may be formed of plexiglas or a reinforced plastic, having a front wall 10, a rear wall 14 and a sloping bottom 16'. Anode A" is connected to a positive terminal 58' and cathode C" to a negative terminal 57', with lead wires 70 and 71 connected to the respective terminals. The voltage drop between terminals 57' and 58' may be on the order of 5 volts, with a 2 ½ volt drop between cathode C" and electrode D and the same voltage drop between electrode D and anode A".

Anode A" and cathode C" rest on insulating baffle plates 63' which extend to the bottom of the tank, while dual electrode D rests on an insulating baffle plate 64' having a hole 65' at the bottom. The anode A" has a hole 72 near the top for flow of electrolyte from inlet 11, while cathode C" has a similar hole 72' for flow of electrolyte into outlet 15. The lower edges of holes 72 and 72' are positioned to maintain a differential in electrolyte levels 73 and 74, at the inlet and outlet, respectively. This differential in level should be sufficient to produce the desired rate of flow of electrolyte across the active faces of the electrodes, such as on the order of 20 to 100 feet per minute.

The flow of electrolyte, as indicated by the arrows 75, is through inlet 11, downwardly between anode A" and electrode D, through hole 65, upwardly between electrode D and cathode C", and thence to discharge through outlet 15. The flow of current is, of course, in the opposite direction, from cathode C", across the electrolyte to anode plate 68, then across electrode D to cathode plate 69 and thence across the electrolyte to anode A". The metal being recovered is, of course, deposited on cathode C" and cathode plate 69. Any bypass current, between cathode C" and anode A", must take a longer path, indicated by arrows 76, extending from the lower edge of cathode C" through hole 65' to the lower edge of anode A". Since the bypass current must take this longer path through a restricted cross section of the electrolyte, the electrical resistance to flow of this bypass current is increased and in accord with Ohm's Law, e.g. $I = E/R$, the amount of bypass current is small relative to the amount of current passing directly from cathode C" to anode plate 68 and thence from cathode plate 69 to anode A". The vertical height of insulating baffle plate 64 should be sufficient, such as from 3 inches to 12 inches, to produce a relatively long path for the bypass current.

As will be evident, the number of intermediate dual electrodes D, in spaced apart relation, may be increased considerably to increase the capacity of the cell. The spacing between adjacent electrodes, as between the electrodes or anodes and cathodes of embodiments previously described should be at least ¼ inch and not more than 3 inches. As indicated previously, the difference between consecutive electrolyte levels should be between ¼ inch and 6 inches.

Although several embodiments of this invention have been illustrated and described, it will be understood that other embodiments may exist and that various changes may be made, all without departing from the spirit and scope of this invention.

What is claimed is:

1. An electrolytic cell for electrowinning of metals, comprising:

an upright, electrolyte containing tank of rectangular lateral configuration, having uniformly spaced, opposed vertical slots along each of its two interior sides;

a series of upright, generally rectangular anodes extending across said tank and having a width to extend into opposed slots at opposite sides of said tank, said anodes being loosely positioned in alternate slots and removable from said slots;

a series of upright, generally rectangular cathodes extending across said tank and having a width to extend into opposed slots at opposite sides of said tank, said cathodes being loosely positioned in slots alternating with the slots of said anodes and removable from said slots;

an inlet at one end of said tank;

an outlet weir at the opposite end of said tank at a lower elevation than the level of electrolyte at the inlet end of said tank;

the construction and arrangement of said anodes and cathodes being such that the electrolyte is forced to flow in an alternating upward and downward path between said anodes and cathodes;

said elevation of said outlet weir being sufficiently below the level of electrolyte at said inlet end of said tank that flow velocities in excess of ten feet per minute will be induced in the electrolyte as it flows downstream between said anodes and cathodes towards the outlet end of said tank and will produce pressure against said anodes and cathodes to maintain said anodes and cathodes against the downstream edges of said slots and spaced from upstream edges of said slots;

means for supplying an electrical current for flow between adjacent anodes and cathodes through said electrolyte.

2. An electrolytic cell as defined in claim 1, wherein:

the vertical drop in the surface level of the electrolyte, as it progresses between each successive cycle of downward and upward flow, is at least ¼ inch and not more than 6 inches; and the horizontal distance between the parallel faces of each anode-cathode pair is at least ¼ inch and not more than 3 inches, whereby flow velocities of 20 to 100 feet per minute will be induced in the electrolyte.

3. An electrolytic cell as defined in claim 1, wherein:

the lower edge of each said cathode or any downward extension thereof is spaced from the bottom of said tank to force said electrolyte to flow under said lower edge; and the upper edge of the electrolytically active area of each said anode or any extension thereof is positioned to force said electrolyte to flow over said upper edge.

4. An electrolytic cell as defined in claim 3, wherein:

the upper edges of said anodes over which said electrolyte flows are positioned in sequence at successively lower elevations from said inlet to said outlet weir.

5. An electrolytic cell as defined in claim 1, wherein:

the lower edge of each said anode or any downward extension thereof is spaced from the bottom of said tank to force said electrolyte to flow under said lower edge; and the upper edge of the electrolytically active area of each said cathode or any extension thereof is positioned to force said electrolyte to flow over said upper edge.

6. An electrolytic cell as defined in claim 5, wherein:

the upper edges of said cathodes over which said electrolyte flows are positioned in sequence at successively lower elevations from said inlet to said outlet weir.

7. An electrolytic cell for electrowinning of metals, comprising:

an upright, electrolyte containing tank of rectangular lateral configuration, having uniformly spaced, opposed vertical slots along each of its two interior sides;

a series of upright, generally rectangular anodes extending across said tank and having a width to extend into opposed slots at opposite sides of said tank, said anodes being positioned in alternate slots and removable from said slots;

a series of upright, generally rectangular cathodes extending across said tank and having a width to extend into opposed slots at opposite sides of said tank, said cathodes being positioned in slots alternating with the slots of said anodes and removable from said slots;

said elevation of said outlet weir being sufficiently below the level of electrolyte at said inlet end of said tank that flow velocities in excess of ten feet per minute will be induced in the electrolyte as it flows downstream between said anodes and cathodes towards the outlet end of said tank and will produce pressure against said anodes and cathodes to maintain said anodes and cathodes against the downstream edges of said slots;

means for supplying an electrical current for flow between adjacent anodes and cathodes through said electrolyte; and electrically non-conductive sheets positioned in the downflow space between said anodes and cathodes to prevent electrodeposition of metal on the surface of said cathodes in said downflow spaces, whereby the electrolytic action occurs only in the upflow spaces between said anodes and cathodes.

8. An electrolytic cell as defined in claim 7, wherein:

said electrically non-conductive sheet is attached to the downflow side of each cathode.

9. An electrolytic cell for electrowinning of metals, in which the electrical current flows in a series circuit between successive electrodes, comprising:

an upright, electrolyte containing tank of rectangular lateral configuration, having uniformly spaced, opposed vertical slots along each of its two interior sides;

an inlet at one end of said tank;

an outlet weir at the opposite end of said tank at a lower elevation than the level of electrolyte at the inlet end of said tank;

a series of upright, generally rectangular, loosely fitted, removable bipolar electrodes extending across said tank and having a width to extend into opposed slots at opposite sides of said tank, one face of each electrode acting as the anode and the opposite face of the same electrode acting as the cathode;

means for supplying an electrical current for flow between adjacent electrodes through said electrolyte;

means for positioning said bipolar electrodes so that the electrolyte, as it enters the cell, flows by gravity pressure in vertical paths between said anode and cathode face and successively under the bottom edge of one said bipolar electrode or extension thereof, then over the top edge of the electrolytically active area of the next said bipolar electrode or extension thereof, said flow pattern being repeated until the electrolyte overflows the weir at the discharge end of said cell; and said weir being positioned at a level which is sufficiently below the surface level of the electrolyte at the inlet end of said cell, so that electrolyte flow velocities in excess of ten feet per minute will be induced in the electrolyte as it flows downstream between said anode and cathode faces and will produce pressure against said electrodes to maintain said electrodes against the downstream edges of said slots and spaced from the upstream edges of said slots.

10. An electrolytic cell as defined in claim 9, including:

a barrier of electrically non-conducting material forming an upward and downward physical extension of said electrodes for a distance of at least three inches above and below the electrolytically active areas of each said bipolar electrode, whereby the bypass of electrical current around the top and bottom edges of the electrolytically active areas of each said bipolar electrode is substantially reduced.

11. An electrolytic cell as defined in claim 10, in which:

said barrier is formed at the bottom of each said bipolar electrode by an electrically non-conducting baffle plate, with the electrolytically active portion of said bipolar electrode in close physical contact therewith and vertically positioned by resting on the upper edge of said baffle plate.

12. An electrolytic cell as defined in claim 10, in which:

said barriers are formed at the top edge of the electrolytically active area of each said bipolar electrode by covering the surface area of said bipolar electrode, above said top edge of the electrolytically active area, with an electrically nonconductive material.

* * * * *